US009737903B2

(12) United States Patent
Notarianni et al.

(10) Patent No.: US 9,737,903 B2
(45) Date of Patent: Aug. 22, 2017

(54) SOAP DISPENSER

(71) Applicant: Tolco Corporation, Toledo, OH (US)

(72) Inventors: George L. Notarianni, Farmington Hills, MI (US); Alberto Martinez, Perrysburg, OH (US)

(73) Assignee: Tolco Corporation, Toledo, OH (US)

( * ) Notice: Subject to any disclaimer, the term of this patent is extended or adjusted under 35 U.S.C. 154(b) by 6 days.

(21) Appl. No.: 14/966,016

(22) Filed: Dec. 11, 2015

(65) Prior Publication Data

US 2016/0167073 A1 Jun. 16, 2016

Related U.S. Application Data

(60) Provisional application No. 62/091,173, filed on Dec. 12, 2014.

(51) Int. Cl.

| | |
|---|---|
| ***B67D 1/00*** | (2006.01) |
| ***B05B 11/00*** | (2006.01) |
| ***A47K 5/12*** | (2006.01) |

(52) U.S. Cl.

CPC ..... *B05B 11/3014* (2013.01); *A47K 5/1205* (2013.01); *A47K 2201/02* (2013.01)

(58) Field of Classification Search

CPC ..... B05B 11/3014; B05B 11/3015; B05B 11/3029; B05B 11/303; B05B 11/3032; B05B 11/3009; A47K 5/1205

USPC ..... 222/153.09, 181.3, 182, 321.8, 322, 222/321.1, 321.7, 321.9

See application file for complete search history.

(56) References Cited

U.S. PATENT DOCUMENTS

| | | | | |
|---|---|---|---|---|
| 5,639,026 A * | 6/1997 | Woods | B05B 1/1654 | 222/402.17 |
| 7,007,867 B1 * | 3/2006 | Drapeau | B05B 1/3436 | 239/333 |
| 7,654,417 B2 * | 2/2010 | Rhodenbaugh | G01F 11/028 | 222/153.03 |
| 8,336,740 B1 * | 12/2012 | Daansen | A47K 5/1207 | 222/181.3 |
| 8,827,116 B1 * | 9/2014 | Hamilton | A47K 5/1202 | 222/180 |

* cited by examiner

*Primary Examiner* — Lien Ngo

(74) *Attorney, Agent, or Firm* — Emch, Schaffer, Schaub & Porcello Co., L.P.A.

(57) ABSTRACT

The invention relates to a soap dispenser that is designed to be mounted on a vertical surface such as a wall. More particularly, the soap dispenser defines a reservoir that is designed to accept bulk quantities of soap. The soap is dispensed from the top of the reservoir by a pump.

27 Claims, 15 Drawing Sheets

SOAP DISPENSER

CROSS REFERENCE TO RELATED APPLICATIONS

This application claims the benefit of U.S. provisional patent application Ser. No. 62/091,173 filed on Dec. 12, 2014.

BACKGROUND OF THE INVENTION

The invention relates to a soap dispenser for soaps, lotion or liquid, and hand sanitizer solutions, any of which may also be of the foaming or non-foaming variety that is normally mounted on a vertical surface such as a wall. (Hereinafter referred to as "soap dispenser" and material to be dispensed as "soap"). In the past wall mounted soap dispensers have normally had a dispensing outlet located near the bottom of the soap dispenser. A lever or dispensing mechanism was moved to pump the soap from the dispenser onto a desired surface, such as the hands of a user. These soap dispensers usually fell into the category of being a bulk fill dispenser or a dispenser that had a pre-measured quantity of soap that was retained in a container such as a pouch. A dispensing nozzle was attached to the bulk soap reservoir or the soap pouch to dispense the soap to the desired surface. These types of soap dispensers had a significant problem in that the dispensing mechanism for the soap would fail periodically and essentially all of the soap in the reservoir or the pouch would be discharged. The soap that was discharged when the dispenser failed was at a minimum a mess to clean up, a waste of expensive soap, and in some applications it created a very slippery surface that presented a significant danger to potential users of the soap dispenser.

The soap dispenser of the present invention overcomes the deficiencies of these prior soap dispensers. The present soap dispenser dispenses the soap from the top of the dispenser and the force of gravity will not allow the soap in the reservoir to be discharged from a failed or malfunctioning dispensing pump. In addition, the present soap dispenser can be bulk filled with either liquid or foam type of soap. The soap dispenser also has a removable soap dispensing pump that makes it easy to service the soap dispenser and to bulk fill the soap dispenser. These and other advantages of the invention will be more readily understood by reading the following description of the invention.

SUMMARY OF THE INVENTION

The invention relates to a soap dispenser that is designed to be mounted on a vertical surface such as a wall. More particularly, the soap dispenser defines a reservoir that is designed to accept bulk quantities of soap. The soap is dispensed from the top of the reservoir by a pump.

DETAILED DESCRIPTION OF THE PREFERRED EMBODIMENT

Figure 1:
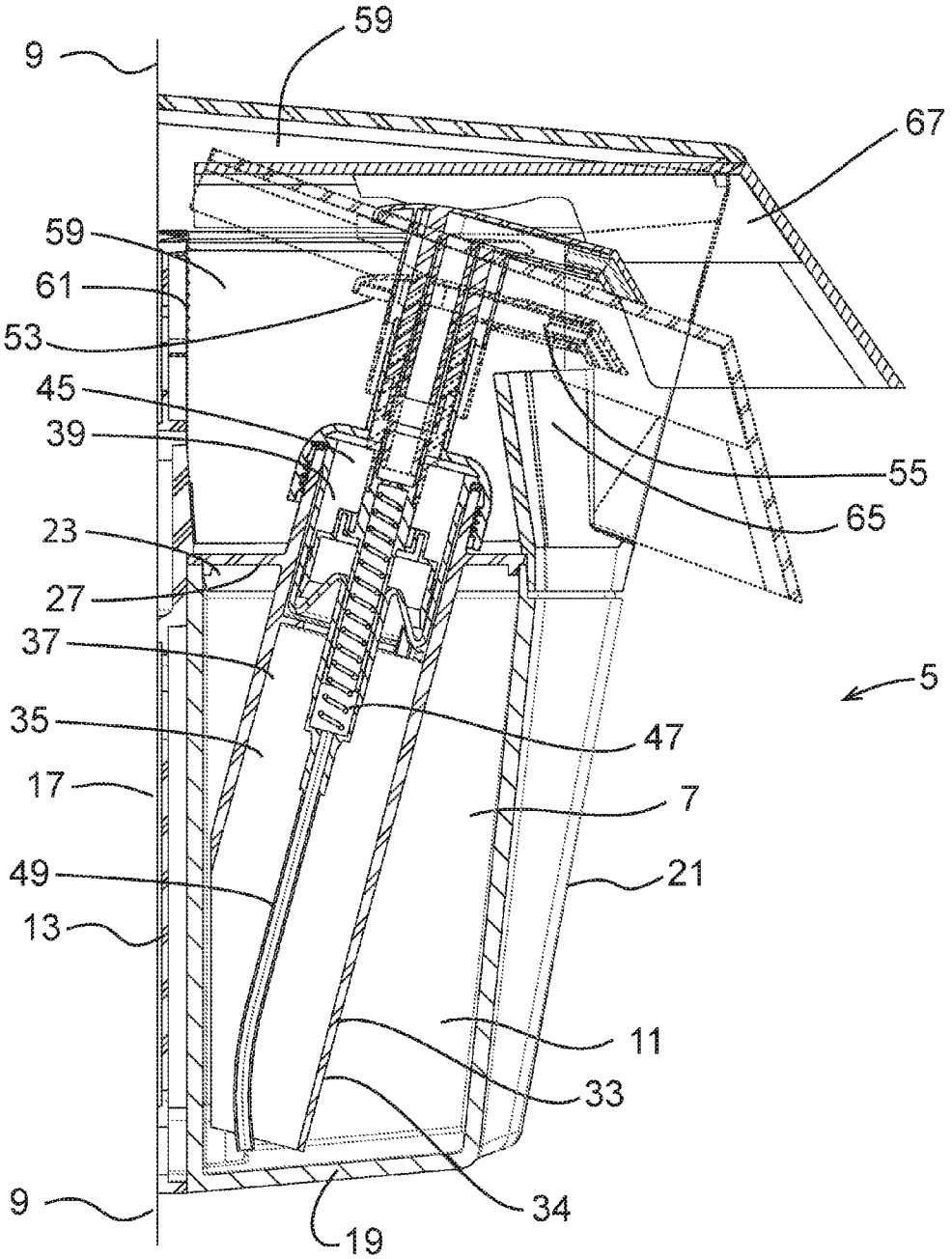
FIG. 1 is a side cross sectional view of the soap dispenser.
Figure 2:
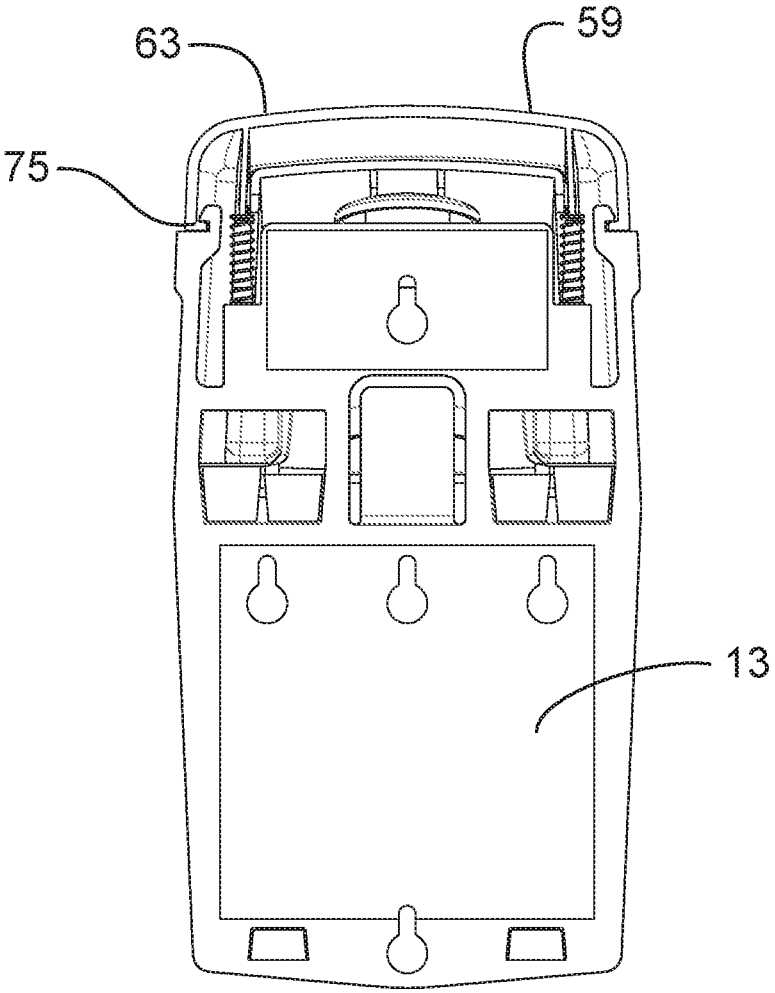
FIG. 2 is a back elevational view of the dispenser.
Figure 3A:
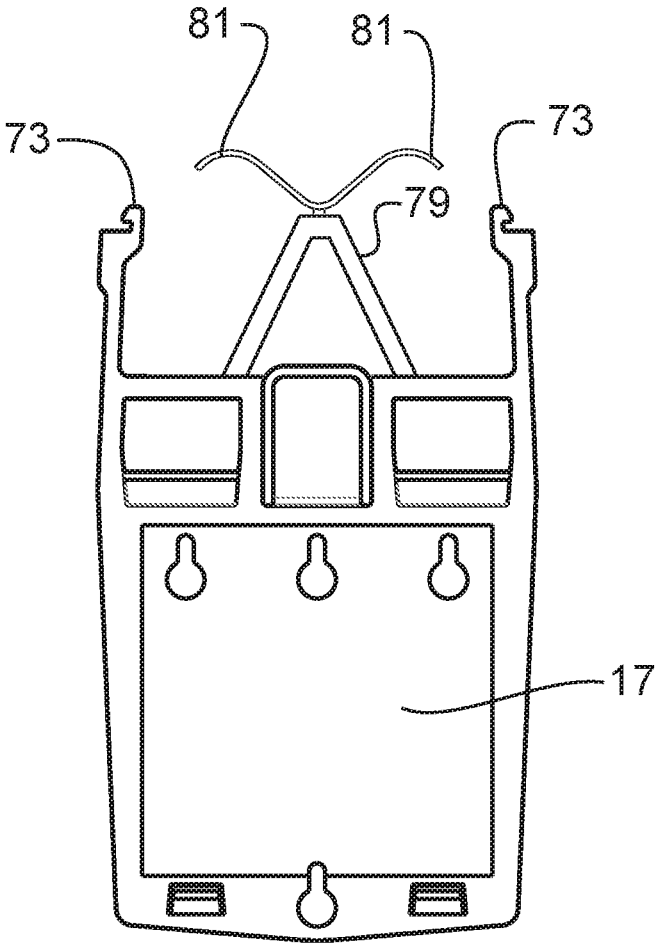
FIG. 3A is a back elevational view of the plate.
Figure 3B:
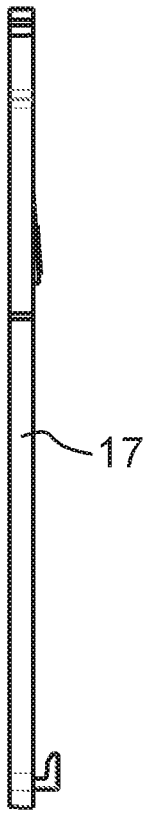
FIG. 3B is a side elevational view of the plate.
Figure 4A:
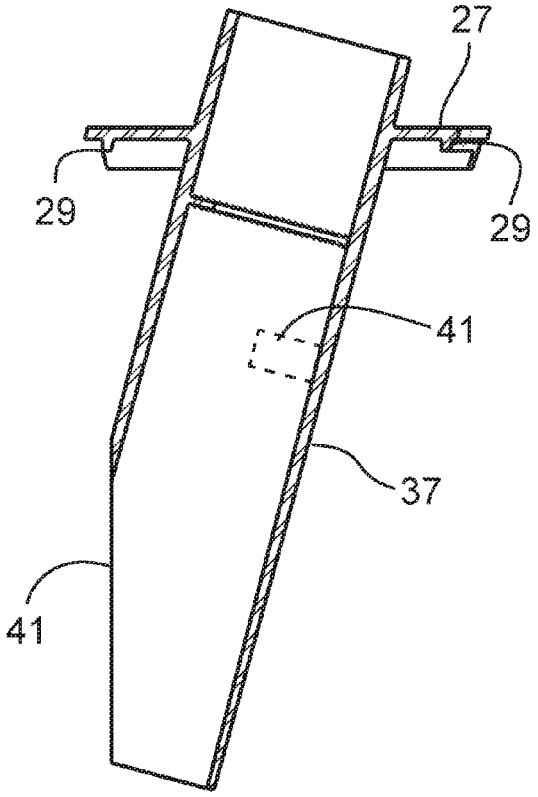
FIG. 4A is a side elevational view of a feature of the dispenser.
Figure 4B:
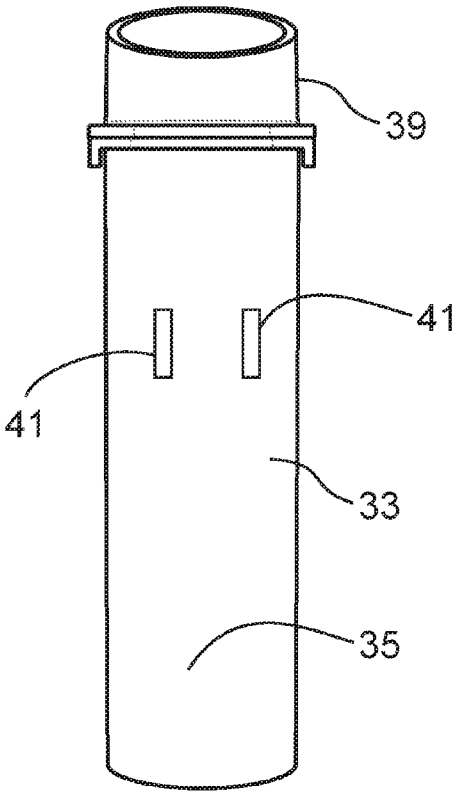
FIG. 4B is a front elevational view of a feature of the dispenser.
Figure 5:
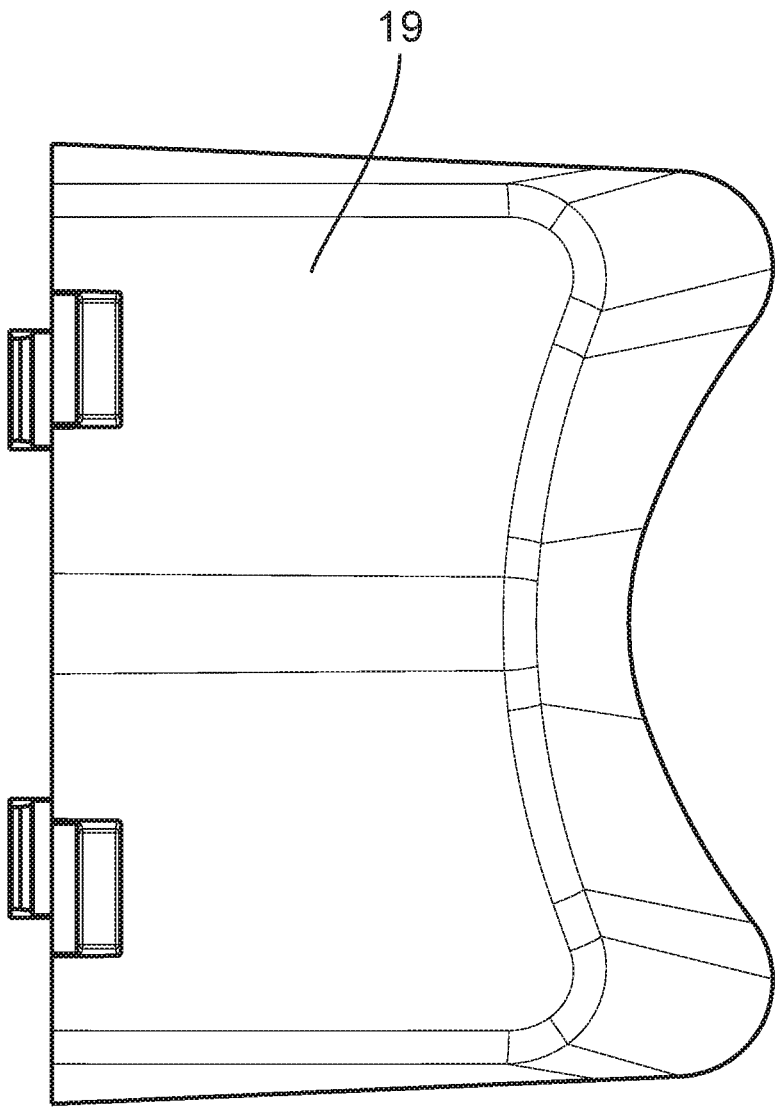
FIG. 5 is a bottom view of the dispenser.
Figure 6A:
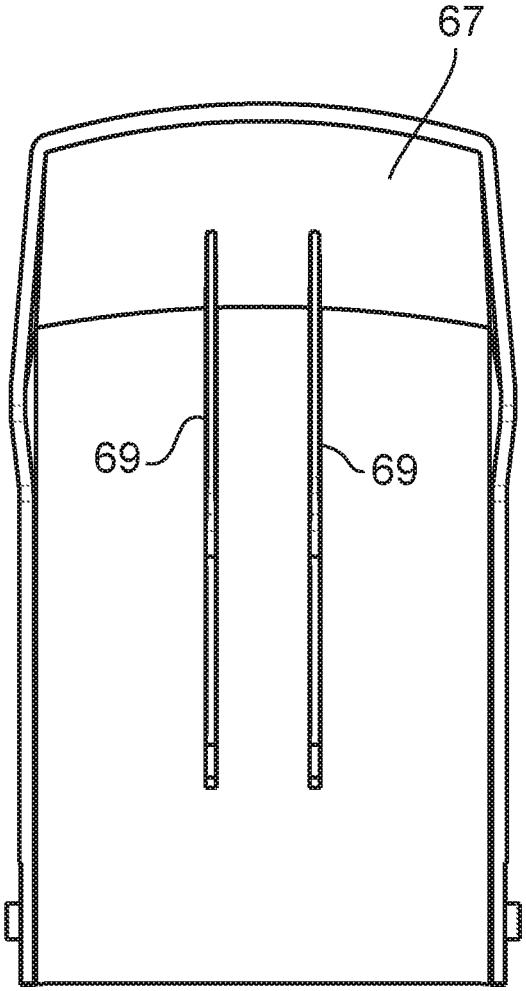
FIG. 6A is a top view of a feature of the dispenser.
Figure 6B:
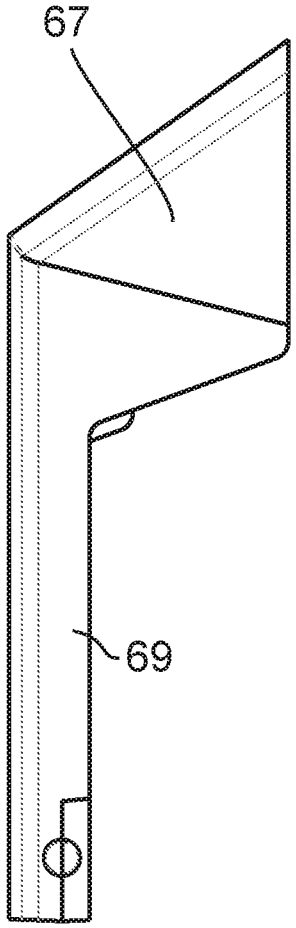
FIG. 6B is a side elevational view of a feature of the dispenser.
Figure 7:
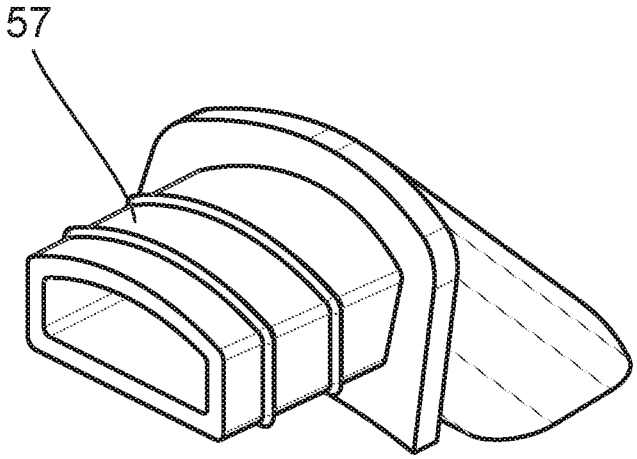
FIG. 7 is a perspective view of a feature of the dispenser.

The invention relates to a dispenser that is designed to be mounted on a vertical surface such as a wall. The dispenser can be used with soaps, lotion or liquid, and hand sanitizer solutions, any of which may be of the foaming or non-foaming variety. For the sake of simplifying the description, the dispenser and the dispensed product will be referred to as soap. It should be appreciated that other products can be dispensed as stated above. More particularly, the soap dispenser defines a reservoir that is designed to accept bulk quantities of soap. The soap is dispensed from the top of the reservoir by a pump. The features of the invention will be readily understood by referring to the attached drawings in connection with the following description.

The soap dispenser 5 is designed to be mounted on a vertical surface such as a wall. The soap dispenser has a reservoir 11 that is designed to hold the soap that is to be dispensed. The reservoir has a back wall 13 that is designed to be mounted to a vertical surface 9. The back wall 13 can also be mounted on a plate 17 and the plate 17 is then mounted on the vertical surface 9 and holds the reservoir 11 in the desired position. The reservoir 11 has a bottom wall 19, sidewalls 21 and defines an opening 23 that is in spaced apart opposed relationship with the bottom wall 19. Reservoir may be made of transparent or translucent material to allow viewing of the soap level within the reservoir. A support member 27 is positioned to extend across the opening 23 of the reservoir 11. The support member has a tab 29 on each end that engages the sidewalls 21 of the reservoir 11. The tabs 29 position the support member 27 with respect to the reservoir, but allow the support member to be removably positioned with regard to the reservoir. A cylindrical canister 33 is secured to the support member 27. The cylindrical canister defines a passageway 35. The cylindrical canister 33 is usually disposed at an angle with respect to the support member 27. The cylindrical canister is usually positioned at an angle from about 5° to about 40° with respect to the support member. First and second portions of the cylindrical canister 33 extends on each side of the support member 27. The first portion 37 extends into the reservoir 11 in a direction towards the bottom wall 19. The first portion 37 extends almost to the bottom wall of the reservoir 11. If need be a section 41 of the sidewall of the cylindrical canister 33 can be disposed at an angle to provide clearance with sidewall 21 of the reservoir 11. The second portion 39 of the cylindrical canister 33 extends from the support member 27 in a direction away from the reservoir 11. A pair of flanges 41 extend from the sidewall 34 in the first portion 37 of the cylindrical canister.

A dispensing pump 45 is positioned on the second portion 39 of the cylindrical canister 33. The dispensing pump 45 extends into the passageway 35 of the cylindrical canister and extends below the support member 27 into the first portion 37 of the cylindrical canister. The flanges 41 disposed on the sidewall 34 of the cylindrical canister 33 engage the dispensing pump 45 to releasably hold the dispensing pump in the desired position in the reservoir 11. The end of the dispensing pump 45 that extends into the passageway 35 has an inlet 47 for receiving material that is to be dispensed by the dispensing pump. A supply tube 49 extends from the inlet 47 to the bottom of the passageway 35 of the cylindrical canister. The supply tube is disposed to supply fluid, positioned in the reservoir, to the inlet 47 of the dispensing pump 45. The dispensing pump 45 has a moveable dispensing head 53 that extends from the second portion 39 of the cylindrical canister 33. The dispensing head has a discharge opening 55 for discharging the fluid pumped by the dispensing pump 45 from the reservoir 11. The discharge opening may have a diverter 57 installed to direct the flow more directly onto the users hand in a more favorable direction. The diverter extends from the discharge opening in the dispensing head 53. The diverter is disposed at an angle towards the reservoir 11. The diverter 57 can assist in dispensing the soap to the desired location.

A cover 59 is positioned on the reservoir 11 that extends over the dispensing pump 45. The sidewall 61 of the cover engage the sidewalls 21 of the reservoir 11. If a plate 17 is used to secure the soap dispenser 5 to the vertical surface 9 the cover 59 can also be secured to the plate 17. The cover 59 defines a dispensing opening 65 that is disposed to be in alignment with the dispensing head 53 of the dispensing pump 45. The dispensing opening 65 is positioned on the portion of the cover 59 that is opposite to the vertical surface 9 on which the soap dispenser 5 is mounted. A dispensing lever 67 is pivotally connected to the sidewall 61 of the cover 59. The dispensing lever is disposed to extend from the dispensing opening 65 in the cover 59. The dispensing lever is pivotally mounted so that it can move in a direction toward and away from the opening 23 in the reservoir 11. The dispensing lever 67 is disposed so that it is positioned above and engages the dispensing head 53 of the dispensing pump 45. The dispensing lever is shown in FIG. 1 in solid lines in the non-dispensing position and in broken lines in the dispensing position. At least one ridge 69 is positioned on the side of the dispensing lever that engages the dispensing head. The ridge engages the dispensing head to hold the dispensing head in the desired position in the dispensing opening 65 for dispensing soap. In some application more than one ridge can be used to hold the dispensing head in the desired location.

The back wall 13 of the reservoir 11 is designed to assist in holding the cover 59 on the reservoir. The back wall beyond the opened top 23 of the reservoir 11. The back wall has at least one locking tab 73 that is designed to engage a ledge 75 on the cover 59. In most applications there is a locking tab 73 positioned on each side of the back wall 13 and the locking tabs engage a ledge on each side of the cover 59. The lock tabs are made of a resilient material so that they can be moved in a direction towards the center of the back wall when the cover 59 is positioned on the reservoir 11. When the reservoir is in the desired position the locking tabs are released and they engage the ledge 75 on each side of the cover. The back wall has a spring mechanism 79 that extends in a direction away from the open top of the reservoir 11. The spring mechanism has at least one resilient arm 81 that is positioned to engage the top wall 63 of the cover 59. The resilient arm places a biasing force against the top wall 63 of the cover and assists in holding the locking tabs 73 in secure engagement with the ledge 75 on the cover 59. If it is desired to remove the cover 59 from the reservoir 11 the locking tabs 73 are displaced and no longer engage the ledge 75 on each side of the cover 59 and the cover then can be removed from the reservoir 11. If a plate 17 is utilized to mount the reservoir 11 on the vertical surface 9 the locking tabs 73 and the spring mechanism 79 can be incorporated into the plate 17 instead of the back wall of the reservoir.

In operation the reservoir 11 is mounted on the vertical surface 9 directly or through the use of the plate 17. A quantity of soap 7 is positioned in the reservoir and then the support member 27 is positioned over the opening 23 in the reservoir. The cylindrical canister 33 extends into the reservoir and into the soap 7 that is present in the reservoir. The dispensing pump 45 is mounted on the cylindrical canister 23 and the flanges 41 on the cylindrical canister releasably hold the dispensing pump in the desired position. The cover 59 with the dispensing lever 67 pivotally attached thereon is then positioned on the reservoir 11. The cover 59 can also be removeably secured to the plate 17 if the plate is used to mount the soap dispenser on the vertical surface 9. To dispense soap from the reservoir 11 the dispensing lever 67 is moved in a direction towards the reservoir 11. This motion of the dispensing lever causes the dispensing head 53 on the dispensing pump 45 to be moved in a direction towards the reservoir 11. This motion of the dispensing head generates a pumping action that will draw the soap 7 in the reservoir 11 through the supply tube 49 into the inlet 47 on the dispensing pump 45. The soap drawn into the dispensing pump is then discharged from the discharge opening 55 on the dispensing head 53. The discharge opening 55 is disposed with respect to the cover 59 that the soap will be discharged from the discharge opening 55 through the dispensing opening 65 in the cover 59. Once the soap 7 has been dispense the dispensing pump 45 will return to its original position and the dispensing lever 67 will be advanced back to a position adjacent the top of the cover 59. When additional soap is required the discharge lever 67 can again be advanced towards the reservoir 11 to repeat the process of dispensing the soap from the reservoir. As the soap 7 is dispensed from the top of the soap dispenser 5 the soap must be pumped up through the supply tube 49, through the inlet 47 and out of the discharge opening 55 by the pumping action of the dispensing 45. It is not possible for the soap 7 to leak from the dispensing pump 45 due to the force of gravity as the soap 7 is positioned beneath the discharge opening 55 and gravity will not cause the soap 7 to flow in this direction without the assistance of the dispensing pump 45.

If it is necessary to replenish the soap in the reservoir 11 the cover 59 is removed from the reservoir 11 to expose the opening 23 in the reservoir. The soap can be added to the reservoir through the opening 23. In addition, the support member 27, including the cylindrical canister 33 and the dispensing pump 45 can be removed from the reservoir 11 to facilitate the addition of soap to the reservoir 11. As the support member and associated equipment is held in place in the reservoir by the tabs 29 it is easy to remove this equipment from the soap dispenser. The reservoir may also be removed from the mounting plate for cleaning or replacement.

If there is a need to service or replace the dispensing pump 45 this pump can be easily removed from the cylindrical canister 33. The dispensing pump 45 is held in place in the cylindrical canister by the flanges 41 and the dispensing pump can be removed from the cylindrical canister by simply sliding the dispensing pump pass the flanges 41.

Soap that is used to fill the soap dispenser 5 can be provided in bulk form to the reservoir 11. The soap can be in liquid or foaming form and the bulking filling of the reservoir 11 reduces the cost of the soap that is used by the soap dispenser 5. In addition, the dispensing pump 45 can have a life that is adequate to accommodate multiple fillings of the reservoir 11 with soap that is to be dispensed. This reduces the cost to service and replace the dispensing pump as the dispensing pump is not designed to be replaced every time the reservoir is replenished with soap 7.

Figure 8:
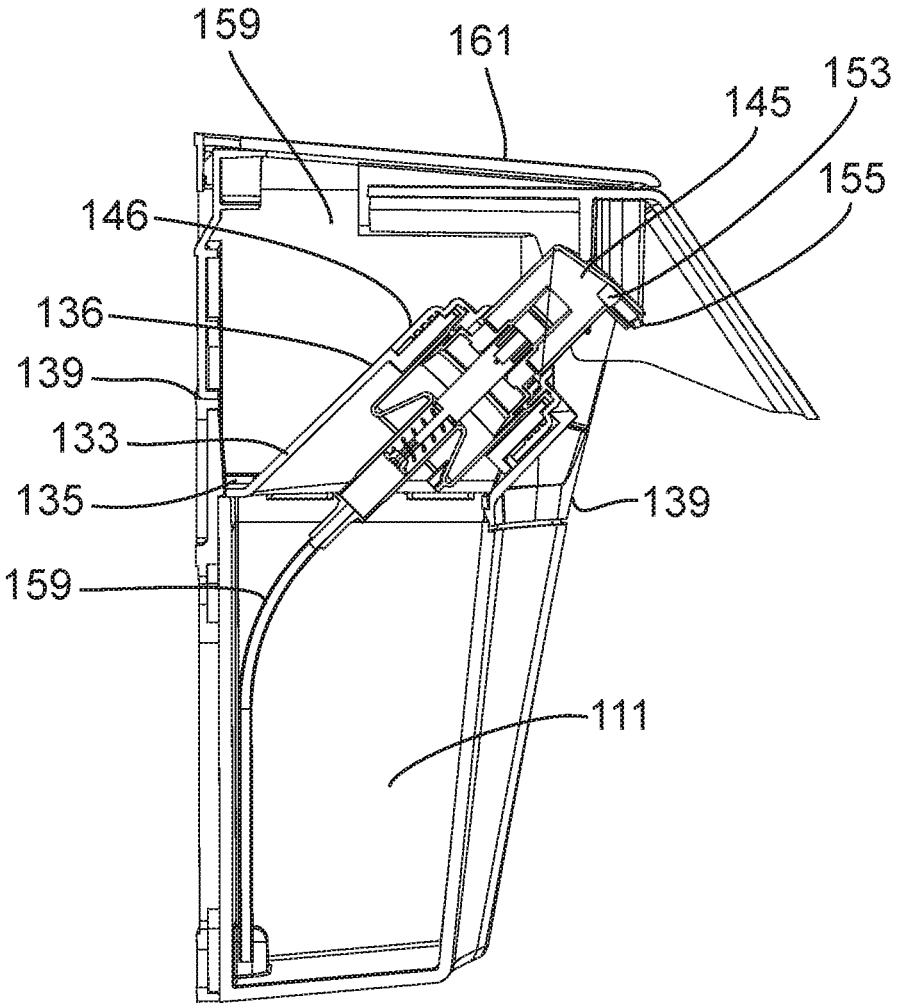
FIG. 8 is a side cross sectional view of additional features of the invention.
Figure 9:
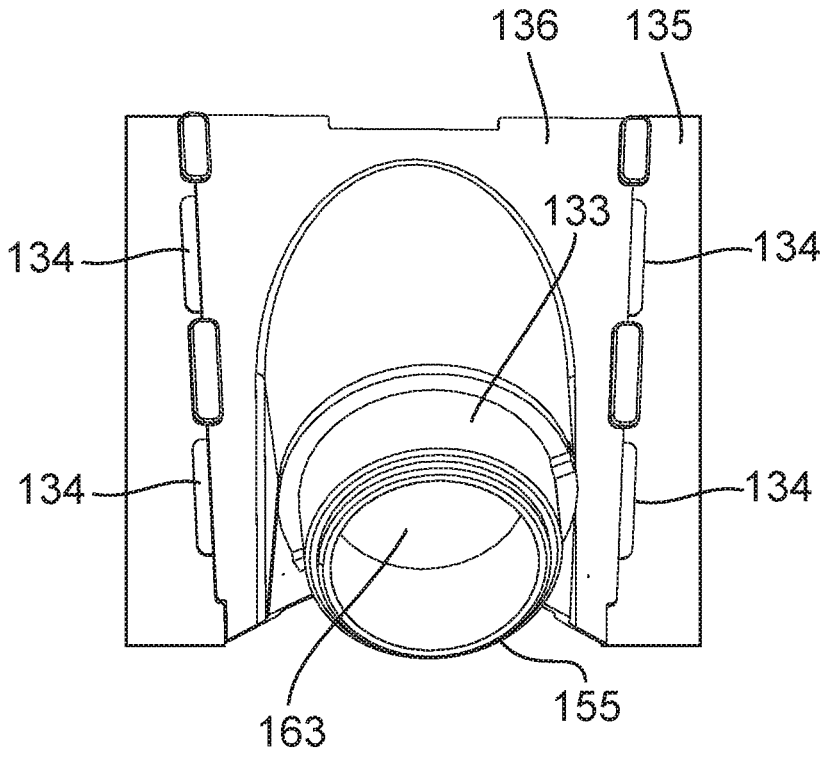
FIG. 9 is a partial perspective view of a feature of the invention.
Figure 10:
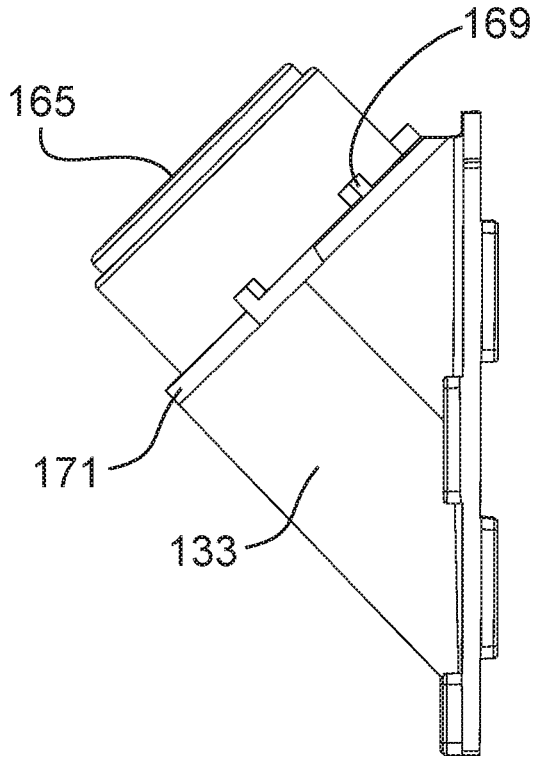
FIG. 10 is a partial side elevation view of a portion of the dispenser.

FIGS. 8-10 show another feature for mounting a dispensing pump in the soap dispenser. The features of the soap dispenser are essentially as previously described and only the features that are different will be described in detail. A support bracket 133 is slidably positioned on legs 135 of the cover 159. The support bracket 133 has tabs 134 that are positioned to engage the top and bottom of the legs 135 that extend from the sidewall 139. The tabs allow the support bracket to be removably positioned on the cover 159. The support bracket has a projection 136 that extends from the support bracket in a direction towards the top 161 of the cover 159. A cylindrical opening 163 is positioned in the projection. The cylindrical opening terminates in an aperture 165 that is adjacent in spaced apart relationship with the top 161 of the cover 159. A tab 169 is positioned on each side of the aperture 165 on a shoulder 171 that is positioned adjacent the aperture 165 on the outer surface of the projection 133.

A dispensing pump 145 is positioned in the aperture 165 and extends into the cylindrical opening 163. The dispensing pump has a collar 146 that engages the shoulder 171 to position the dispensing pump in the desired location in the cylindrical opening. The collar 146 has a recess 148 that is designed to engage the tabs 169 on the shoulder 171 to prevent the collar 146 and the dispensing pump 145 from rotating with respect to the cylindrical opening 163 in the projection 133. The projection positions the dispensing head 153 of the dispensing pump 145 adjacent the dispensing lever 167. The dispensing pump and the dispensing lever function in the manner previously described to allow the dispensing lever to engage the dispensing head to discharge fluid from the discharge opening 155. A supply tube 159 extends from the end of the dispensing pump that is positioned in the projection and spaced apart from the dispensing head. The supply tube extends into the reservoir 11 to supply fluid to the dispensing pump 145. The dispensing lever 67 of the cover engages the dispensing head 153 of the dispensing pump 145 to hold the dispensing pump in position in the cylindrical opening 163 of the projection 133 on the support bracket 136. When the support bracket is removed from the cover 159 by slidably disengaging the tabs 134 from the legs 135, the dispensing pump 145 can be slid from the cylindrical opening 163 to allow for easy replacement, repair or service of the dispensing pump.

Figure 11:
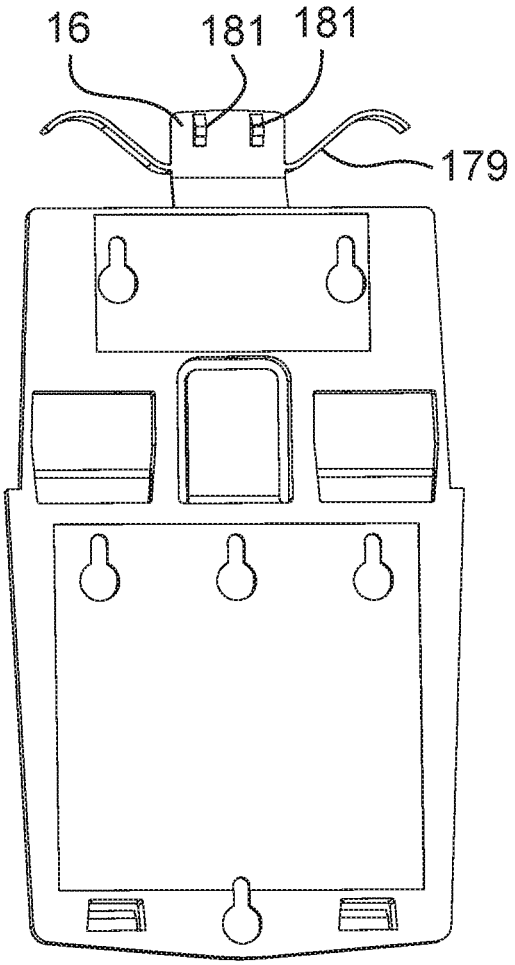
FIG. 11 is a rear elevation view of a portion of the dispenser.
Figure 12:
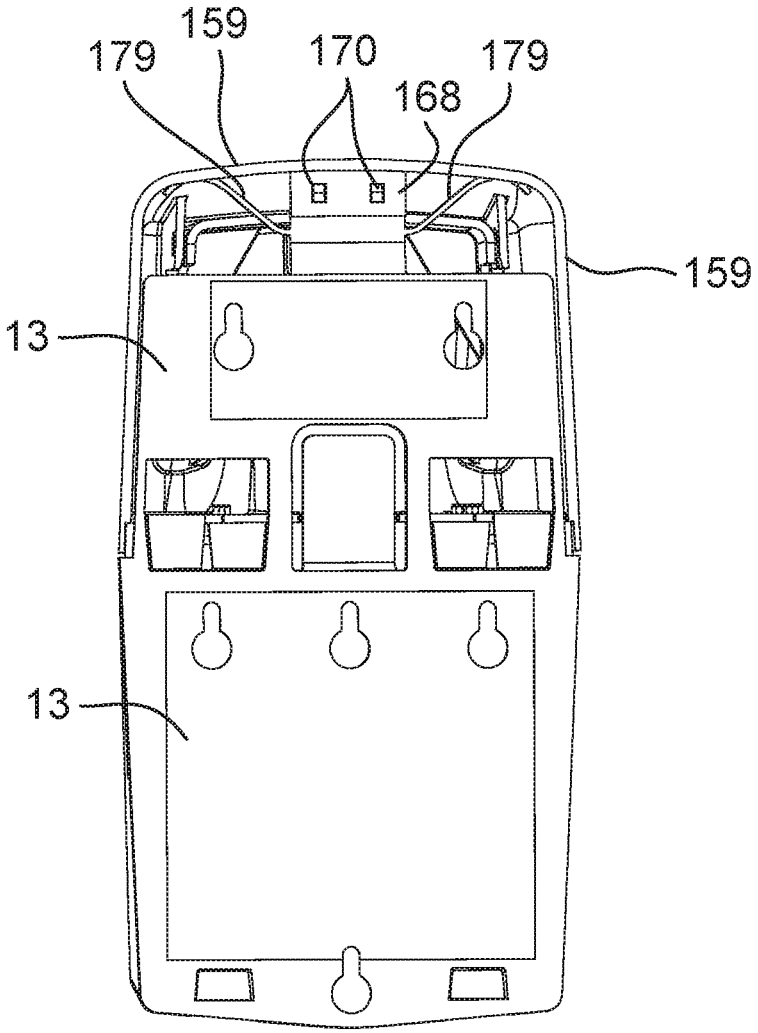
FIG. 12 is a rear elevation view of the dispenser.
Figure 13:
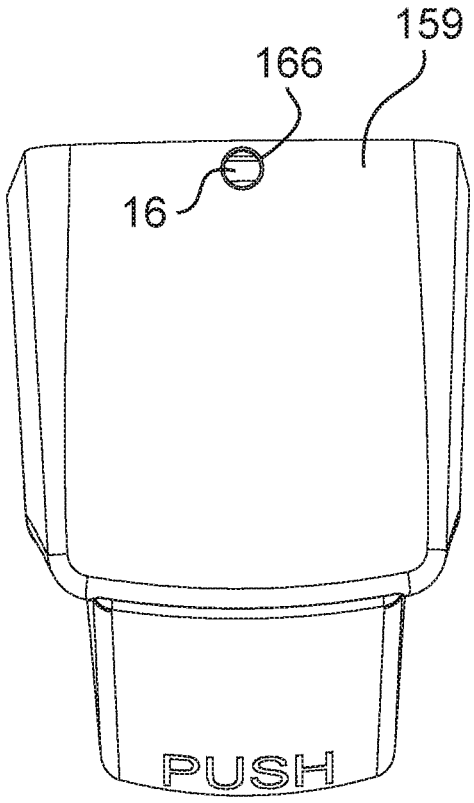
FIG. 13 is a top view of the dispenser.

FIG. 11-13 shows another way that the back of the cover 159 can be secured to the back wall 13 of the reservoir. The back wall has the spring mechanism 179 as previously described. The spring mechanism functions in the same manner as previously described to provide a biasing force to assist in holding the cover 159 in position with respect to the reservoir. Positioned behind the spring mechanism on the back wall 13 is at least one ledge 181. The ledges are positioned on a resilient member 16 that supports the spring mechanism. The cover 159 has a section 168 that extends from the back of the cover. The section has at least one opening 170 that is disposed to be in alignment with the at least one ledge positioned on the resilient member 16. When the cover 159 is properly positioned with respect to the back wall of the reservoir the at least ledge will be positioned in the at least one opening in the section 168 and the interaction of the ledges and openings will act to secure the cover 159 in position with respect to the back wall 131 of the reservoir. A release opening 166 is positioned in the top of the cover 159 above the resilient member 16. To release the cover from the back wall 13, a tool can be inserted into the release opening 166 to move the resilient member 16 away from section 168 so that the at least one ledge 181 is displaced from the at least one opening 170 to release the cover from the back wall.

Figure 14:
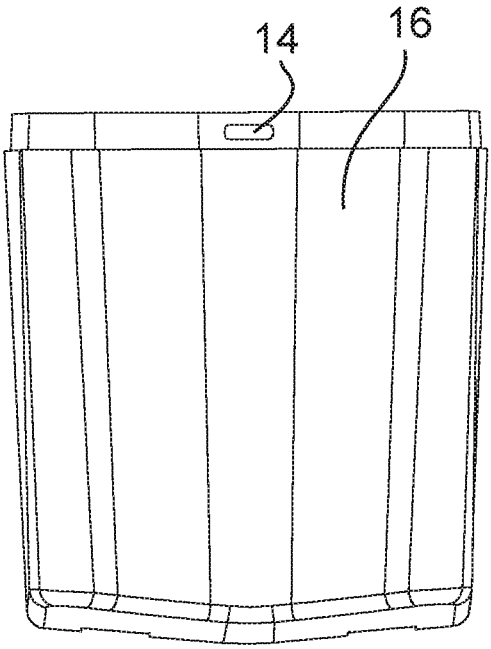
FIG. 14 is a front view of the reservoir of the dispenser.
Figure 15:
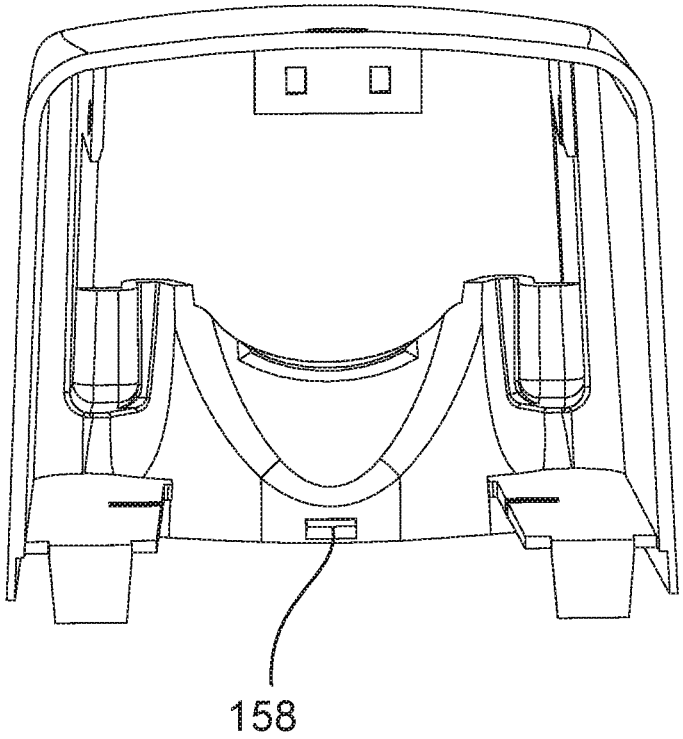
FIG. 15 is a top view of the dispenser.

To assist in securing the cover 159 on the reservoir 11, a slot 14 can be positioned on the front of the reservoir adjacent the edge of the cover as shown in FIGS. 14 and 15. A detent 158 is positioned on the cover in a location to engage the slot 14. The detent engages the slot in a manner that act to secure the front of the reservoir 11 to the front of the cover 159.

What we claim:

1. A wall mounted bulk soap dispenser comprising:

a reservoir for holding soaps, lotions or sanitizers, foaming or non-foaming, having a back wall that is disposed for mounting on a wall, the reservoir having an open top;

a support member removably positioned in the reservoir adjacent the open top;

a pump positioned on the support member, the pump being disposed at an angle from about 5° to about 40° with respect to the support member, the pump being disposed at an angle with respect to the back wall;

a supply tube extending from the pump into the reservoir, the supply tube being disposed to transfer fluid from the reservoir to the pump, a cover removably mounted on the open top of the reservoir, the cover having a dispensing opening, and;

a lever pivotably connected to the cover adjacent the open top, the lever being disposed to engage the pump, movement of the lever being designed to activate the pump to dispense soap to a user.

2. The dispenser of claim 1 wherein the lever has a ridge that engages the pump to retain the pump in the desired position.

3. The dispenser of claim 1 wherein the reservoir has a concave front that provides access for the user to receive the soap.

4. The dispenser of claim 1 wherein the reservoir is translucent and allows the level of soap in the reservoir to be visible.

5. The dispenser of claim 1 wherein the pump dispense the soap in a downward direction to the user.

6. The dispenser of claim 1 wherein a cylindrical canister is positioned on the support member, the cylindrical canister being disposed for releasably securing the pump with respect to the reservoir.

7. The dispenser of claim 6 wherein at least one flange extends from the cylindrical canister and engages the pump to position the pump in the desired position.

8. The dispenser of claim 1 wherein the angle of the pump directs the supply tube to the lowest point in the reservoir.

9. The dispenser of claim 1 wherein a diverter is positioned on the pump to direct the soap discharged from the pump in a desired direction.

10. The dispenser of claim 1 wherein the back wall of the reservoir extends beyond the open top, the back wall having at least one locking tab that is disposed for releasably engaging the cover.

11. The dispenser of claim 10 wherein the at least one locking tab is resiliently biased to releasably engage the cover and to secure the cover to the reservoir.

12. The dispenser of claim 11 wherein a locking tab is disposed on each side of the back wall.

13. The dispenser of claim 11 wherein a spring mechanism is positioned on the back wall, the spring mechanism being disposed to engage the cover and to bias the cover in a direction away from the reservoir and against the at least one locking tab.

14. A wall mounted bulk soap dispenser comprising:

a reservoir for holding soaps, lotions or sanitizers, foaming or non-foaming, having a back wall that is disposed for mounting on a wall, the reservoir having an open top;

a cover removably mounted on the open top of the reservoir, the cover having a dispensing opening;

a support member removably positioned in the cover adjacent the open top;

a pump positioned on the support member, the pump being disposed at an angle from about 5° to about 40° with respect to the support member, the pump being disposed at an angle with respect to the back wall, the pump having a dispensing nozzle that is located adjacent the top of the cover;

a supply tube extending from the pump into the reservoir, the supply tube being disposed to transfer fluid from the reservoir to the pump, and;

a lever pivotably connected to the cover adjacent the open top, the lever being disposed to engage the pump, movement of the lever being designed to activate the pump to dispense soap to a user.

15. The dispenser of claim 14 wherein the lever has a ridge that engages the pump to retain the pump in the desired position.

16. The dispenser of claim 14 wherein the reservoir has a concave front that provides access for the user to receive the soap.

17. The dispenser of claim 14 wherein the reservoir is translucent and allows the level of soap in the reservoir to be visible.

18. The dispenser of claim 14 wherein the dispensing nozzle of the pump dispenses the soap in a downward direction to the user.

19. The dispenser of claim 14 wherein a projection having a cylindrical opening is positioned on the support member, the cylindrical opening being disposed for releasably securing the pump with respect to the cover and reservoir.

20. The dispenser of claim 19 wherein at least one flange extends from the projection adjacent the cylindrical opening and engages the pump to position the pump in the desired position.

21. The dispenser of claim 14 wherein the angle of the pump directs the supply tube to the lowest point in the reservoir.

22. The dispenser of claim 14 wherein a diverter is positioned on the pump to direct the soap discharged from the pump in a desired direction.

23. The dispenser of claim 14 wherein the back wall of the reservoir extends beyond the open top, the back wall having at least one locking ledge that is disposed for releasably engaging the cover.

24. The dispenser of claim 23 wherein the at least one locking ledge is resiliently biased to releasably engage the cover and to secure the cover to the reservoir.

25. The dispenser of claim 24 wherein at least one locking ledge is disposed to engage at least one opening in the reservoir.

26. The dispenser of claim 24 wherein a spring mechanism is positioned on the back wall, the spring mechanism being disposed to engage the cover and to bias the cover in a direction away from the reservoir and against the at least one locking tab.

27. The dispenser of claim 14 wherein a slot is positioned on the reservoir, the slot being disposed to engage a detent on the cover to assist in securing the cover to the reservoir.

* * * * *